US007784963B2

(12) United States Patent
Galli et al.

(10) Patent No.: US 7,784,963 B2
(45) Date of Patent: Aug. 31, 2010

(54) MULTI-FUNCTION FLASHLIGHT

(75) Inventors: Robert D. Galli, North Kingstown, RI (US); Christopher J. O'Brien, Wakefield, RI (US); Alexander Calvino, Cranston, RI (US)

(73) Assignee: Emissive Energy Corporation, North Kingstown, RI (US)

( * ) Notice: Subject to any disclaimer, the term of this patent is extended or adjusted under 35 U.S.C. 154(b) by 79 days.

(21) Appl. No.: 12/258,530

(22) Filed: Oct. 27, 2008

(65) Prior Publication Data

US 2009/0190339 A1 Jul. 30, 2009

Related U.S. Application Data

(60) Provisional application No. 61/024,293, filed on Jan. 29, 2008.

(51) Int. Cl.
*F21V 33/00* (2006.01)
*F21L 4/02* (2006.01)

(52) U.S. Cl. ..... 362/184; 362/205; 362/259; 362/800

(58) Field of Classification Search ..... 362/184, 362/190, 191, 205, 259, 800
See application file for complete search history.

(56) References Cited

U.S. PATENT DOCUMENTS

| | | | | |
|---|---|---|---|---|
| 6,095,661 | A * | 8/2000 | Lebens et al. | 362/184 |
| 6,402,339 | B1 * | 6/2002 | Mukogawa et al. | 362/184 |
| 6,669,353 | B2 * | 12/2003 | Kung | 362/191 |
| 6,722,771 | B1 * | 4/2004 | Stephens | 362/184 |

* cited by examiner

*Primary Examiner*—Stephen F Husar
(74) *Attorney, Agent, or Firm*—Barlow, Josephs & Holmes, Ltd.

(57) ABSTRACT

A multi-function flashlight device is provided in either an all white light emitting diode (LED) or a colored LED version that allows versatile functionality. The flashlight is fashioned to have an outer housing that includes both an integrated means for interfacing the flashlight with a firearm and a surface thereon that serves as a handgrip. The outer housing of the flashlight is configured to be engaged by a clamping assembly that facilitates integration of the flashlight with standard firearm accessory rail assemblies. The flashlight head includes a high-output white LED positioned centrally within an optical element such as a reflector. Should the flashlight be a colored light, four other positions are provided around the periphery of the lens that contain colored LEDs. The flashlight provides the user the ability to selectively and individually control the mode of operation for all of the LEDs contained therein.

18 Claims, 9 Drawing Sheets

MULTI-FUNCTION FLASHLIGHT

CROSS-REFERENCE TO RELATED APPLICATIONS

This application is related to and claims priority from earlier filed U.S. Provisional Patent Application No. 61/024,293, filed Jan. 29, 2008.

BACKGROUND OF THE INVENTION

The present invention relates generally to multi-functional flashlight assemblies. More specifically, the present invention relates to a multi-functional flashlight assembly that includes a unique switching mechanism that provides a plurality of different functions while also exhibiting ease of use and increased durability even in rugged use environments, such as those encountered in military applications In the prior art, flashlights for use in military applications have typically been constructed in a standard fashion with a large diameter tubular outer housing. As a consequence, such a flashlight required a large mounting assembly in order to facilitate mounting of the flashlight onto a weapon such as an M-16 rifle. Generally, modern type firearms include such an interface rail integrated thereon for the mounting of auxiliary devices. The rail is known in the art as a Weaver type interface and takes the form of a rail having a dovetail cross-sectional profile that extends over the receiver of the firearm. Additionally, there are several supplemental rail systems that mount onto such firearms by interfacing with the Weaver rail on the firearm and extending along and around the barrel to provide additional interface rails both along the top of the firearm as well as at the 3, 6 and 9 o'clock positions around the barrel. All of the interface rails are provided having a standardized profile and are configured specifically for the mounting of various accessories depending on the type environment in which the firearm will be used.

To interface a flashlight with an interface rail a mount is provided that typically employs a heavy gauge band, which is wrapped around the entire outer housing of the flashlight and also includes projections to one side of the band where a large thumbscrew is positioned to allow a user to tighten the band around the flashlight. Further, the band is affixed to a mounting clamp that allows the band containing the flashlight to be installed onto the firearm interface rail. The difficulty is that such an interface is bulky and is prone to snagging on things as the solider quickly moves in a combat situation.

Other difficulties with such flashlights include the fact that they are typically single function devices that must be exchanged for a different flashlight should the need for an additional function arise, such as for example, in infra-red applications. In these situations, the user must carry several different lighting devices with them so that, as the need arises, the user can exchange lighting devices. In addition, should a flashlight include multi-functional features, often the controls are small and fussy making them difficult to operate in the typical military environment where the user is often wearing gloves. In these applications small buttons, sliders and knobs are nearly impossible to operate in a reliable fashion.

In view of the foregoing disadvantages inherent in the prior art devices, there is a need for a device that provides multi-functionality in an improved flashlight construction that is easier to operate and exhibits a high degree of reliability even in the most rugged environment. There is a further need for a multi-function flashlight that is modular in construction to thereby allow the interchangeability of parts thereon so that the flashlight can easily be maintained in operable condition.

BRIEF SUMMARY OF THE INVENTION

The present invention provides a novel flashlight assembly that includes multi-functionality yet is rugged and easy to operate. The multi-function flashlight device of the present invention is provided in either an all white light emitting diode (LED) or a colored LED version that allows versatile functionality as will be discussed in further detail below. Generally, the flashlight of the present invention (regardless of white or colored version) is fashioned to have an outer housing that includes both an integrated means for interfacing the flashlight with a firearm and a surface thereon that serves as a handgrip for assisting a user in holding the firearm itself. The outer housing of the flashlight in the present invention is configured to be engaged by a clamping assembly that facilitates integration of the flashlight with any of these standard accessory rail assemblies such that the interface is a seamless and integrated feature of the outer housing of the flashlight itself while eliminating the need for a band that wraps entirely around the flashlight housing.

The flashlight head includes a high-output white LED positioned centrally within an optical element such as a reflector or lens. Should the flashlight be a colored light, four other positions are provided around the periphery of the lens that contain colored LEDs. For example, in a colored version of the flashlight, the periphery LEDs can be provided as red, green, blue and infrared while the central light is a high intensity white light. In combination with the control mechanism that will be more fully described below, this allows for a highly versatile and multi-functional flashlight. It should also be appreciated that in the white only version of the light, only the central white LED will be provided and the four peripheral LEDs will not be included.

The control for the multi-functionality of the flashlight of the present invention is provided in a novel user interface arrangement, wherein a combination of a momentary switch and a variable resistance switch are employed to send control signals for the operation of the light itself. To facilitate reliable communication of these signals between the user interface switch and the LED circuit board at the front of the flashlight, the present invention employs a novel bus system. In this arrangement there are three bus bars, one to bring power from the rear of the light to the LED board at the front of the light and two to bring signals from the momentary switch and the resistive switch respectively.

A circuit board is provided in the user interface that includes a variable resistance element formed thereon. The variable resistance element may be formed as two continuous resistance strips on the surface of the circuit board and a rotational member in the user interface includes a wiper that bridges between the two resistance strips. Rotation of the rotational member also serves to rotate the wiper relative to the resistance strips. In addition, a push button actuator in the user interface allows the user to press the actuator that in turn depresses a dome switch to generate a momentary contact signal. As was stated above, the power from the rear terminal of the battery is transmitted up one of the bus bars, the resistance signal as read between the resistance strips and the wiper is sent up a second of the bus bars and the signal from the push button switch is sent along the third bus bar. In operation, the flashlight employs a combination of the resistance value detected relative to the position of the wiper and the momentary signal received from the push button switch in order to determine the manner in which the user wants the flashlight to operate. In essence, the resistive value toggles the flashlight through various different operational modes such as momentary, full on, strobe, programming mode, etc. While the push button is used in order to determine the brightness or mode in which the flashlight will operate.

Optionally, the continuous wiper arrangement of the variable resistance element may be replaced with several indexed positions that generate several different fixed and known resistive values. In this regard, each rotation of the user interface moves the indicator into a fixed resistance position that is read by the operational circuit of the flashlight and is used to execute a predetermined operational command. As a result the control arrangement of the present invention facilitates an adaptive light technology that allows the flashlight interface components and the various different flashlights to adapt to one another allowing interoperability.

Accordingly, it is an object of the present invention to provide a device that includes multi-functionality in an improved flashlight construction that is easier to operate and exhibits a high degree of reliability even in the most rugged environment. It is a further object of the present invention to provide a multi-function flashlight that is modular in construction to thereby allow the interchangeability of parts thereon so that the flashlight can easily be maintained in operable condition.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
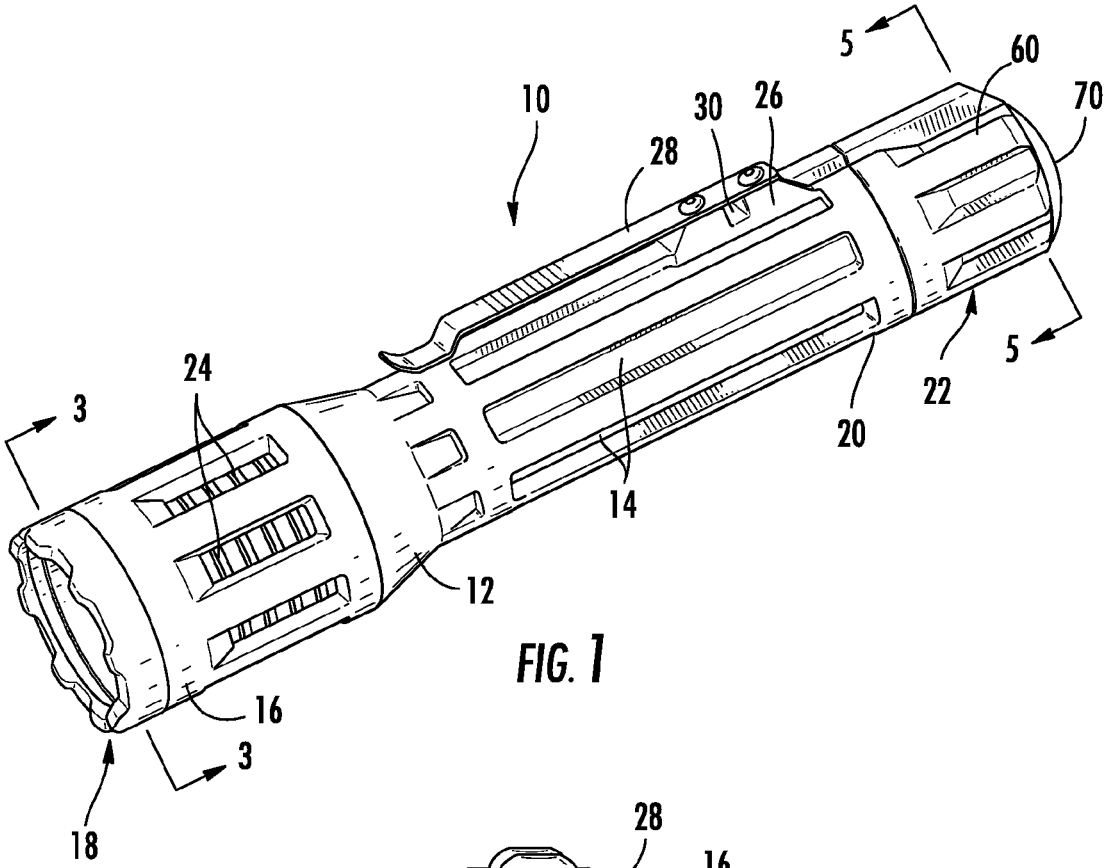
FIG. 1 is a perspective view of the multi-functional flashlight of the present invention.

Now referring to the drawings, the multi-functional flashlight of the present invention is shown and generally illustrated in the figures. The flashlight assembly of the present invention that includes multi-functionality yet is rugged and easy to operate. The flashlight is provided in either an all white LED or a colored LED version that allows versatile functionality as will be discussed in further detail below.

As can be seen in FIG. 1, the flashlight 10 generally includes an outer housing 12 that has an outer surface with grooves 14 therein which serve as both an integrated means for interfacing the flashlight with a firearm. The outer housing 12 includes a first end 16 that receives a flashlight head 18 and a second end 20 that receives the user interface 22 in the form of a user interface 22 for controlling the operational aspects of the flashlight 10.

Turning to the outer housing 12 of the flashlight 10 in detail, the outer housing 12 of the flashlight 10 can be seen to include grooves 14 formed therein. The grooves 12 in the outer housing 12 of the flashlight 10 serve both as a rugged gripping surface and also as a means for interfacing the flashlight 10 with a firearm (not shown). As was stated above, modern type firearms generally include an interface rail integrated thereon for the mounting of auxiliary devices. The rail is known in the art as a Weaver type interface and takes the form of a rail having a dovetail cross-sectional profile that extends over the receiver of the firearm. Additionally, there are several supplemental rail systems that mount onto such firearms by interfacing with the Weaver rail on the firearm and extending along and around the barrel to provide additional interface rails both along the top of the firearm as well as at the 3, 6 and 9 o'clock positions around the barrel. All of the interface rails are provided having a standardized profile and are configured specifically for the mounting of various accessories depending on the type environment in which the firearm will be used. The grooves 14 in the outer housing 12 of the flashlight 10 in the present invention are configured to be engaged by a clamping assembly (not shown) that facilitates integration of the flashlight 10 with any of these standard accessory rail assemblies such that the interface is a seamless and integrated feature of the outer housing 12 of the flashlight itself.

Additionally, the outer housing 12 of the flashlight 10 can be seen to include openings 24 therein adjacent the flashlight head 18. The openings 24 are positioned such that waste heat generated during operation of the flashlight head 18 can easily be dissipated away from the flashlight 10 and to the ambient environment via the openings 24 as will be discussed in detail below. The outer housing 12 can also be seen to include a mounting platform 26 consisting of two spaced apart raised structures to which a belt clip 28 is fastened. The raised structures of the mounting platform 26 cooperate with the belt clip 28 to enclose a hole 30 therethrough such that a lanyard can be affixed to the flashlight 10 if so desired by the user.

Figure 2:
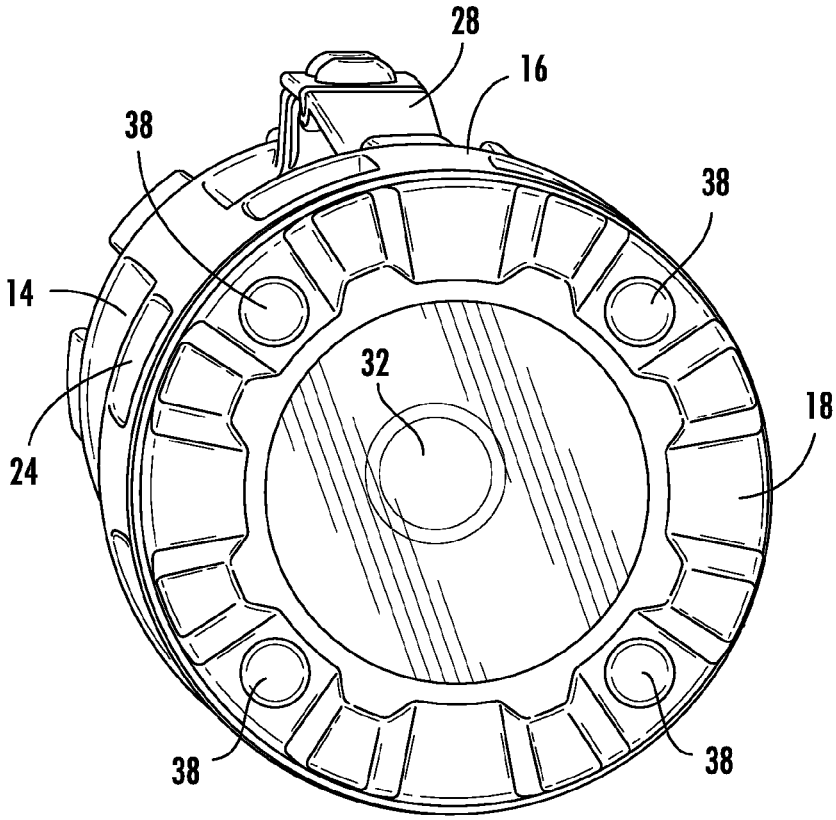
FIG. 2 is a front end view of the multi-functional flashlight of the present invention.
Figure 3:
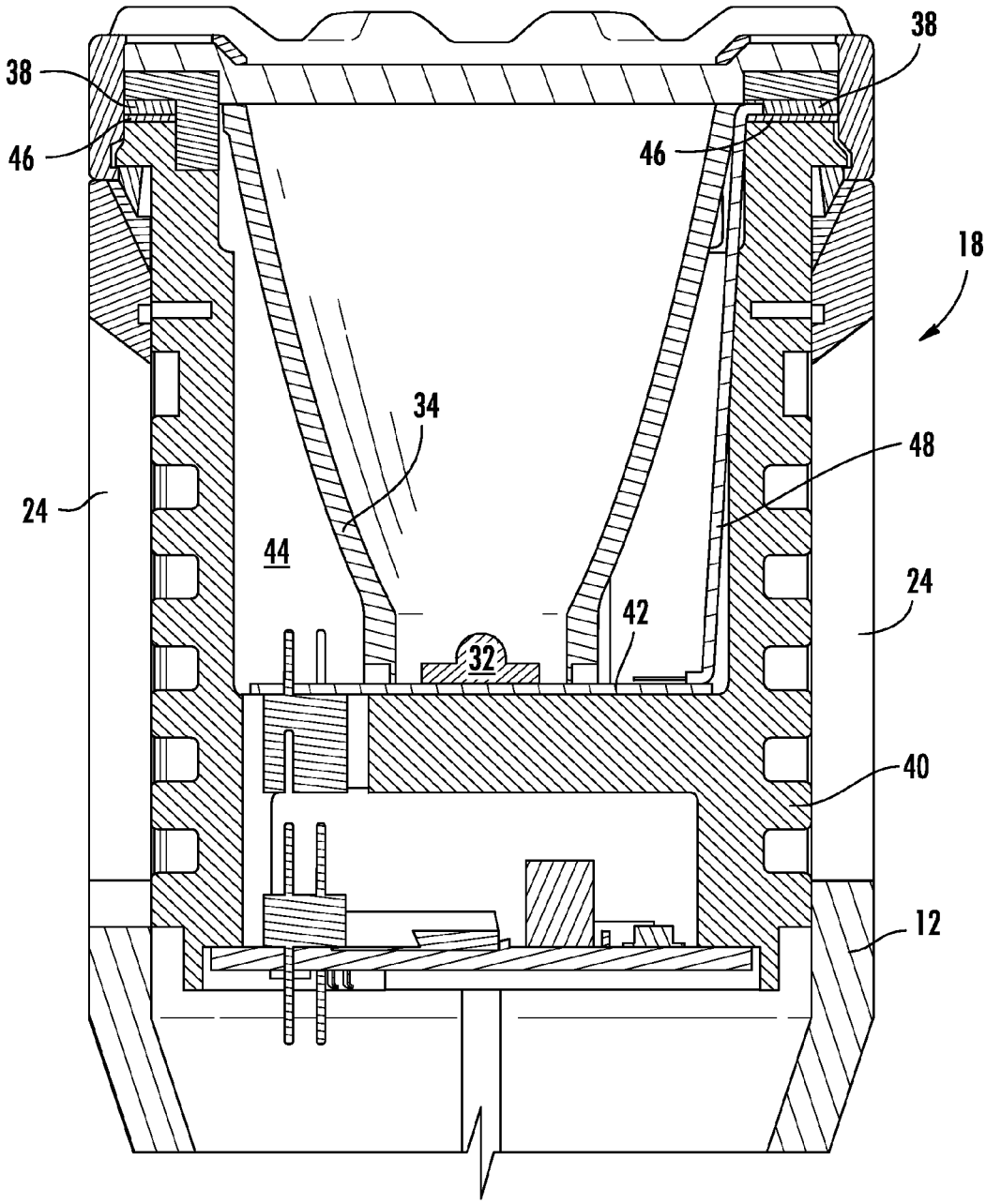
FIG. 3 is a cross sectional view of the head portion of the multi-functional flashlight of the present invention taken along Line 3-3 of FIG. 1.

Turning now to FIGS. 2 and 3 in combination, a front view of the flashlight 10 and a cross-sectional view of the flashlight head 18 are shown. As can be seen in these figures, the flashlight 10 includes at least one LED 32 depicted centrally. This first LED 32 is preferably a high-output LED but could be any type LED suitable for such an application. Further, while the first LED 32 is preferable white in color, it could also be red, green, blue, infrared or ultraviolet. The first LED 32 is shown positioned within a reflector 34. While a reflector 34 will assist in greatly improving the illumination efficiency of the flashlight 10, it can be appreciated by one skilled in the art that the reflector 34 is not required. Further, it is also possible within the scope of the present invention that an alternate optical element be employed in place of the reflector 34 such as for example a lens or a total internal reflector (TIR) lens device and that any such variation is intended to fall within the scope of the present invention. Around the outer peripheral edge 36 of the front end of the flashlight housing 12, at least one LED 38 can be seen. Preferably a plurality of LEDs 38 are provided at the peripheral edge 36. Further, while the LEDs 38 can be seen to be evenly spaced around the peripheral edge 36 of the flashlight housing 12, these LEDs 38 could also be grouped together and still fall within the intended scope of the present invention. The peripheral LEDs 38 may be matched in color with the first LED 32. Similarly, they may be matched in color with one another yet be different in color from the first LED 32. Finally, the peripheral LEDs 38 may be different in color from the first LED 32 and from one another. While the peripheral LEDs 38 may be of any color, it is preferred that the periphery LEDs 38 be provided in a color such as red, green, blue, white, ultraviolet and/or infrared. In combination with the control mechanism of the user interface 22 that will be more fully described below, this allows for a highly versatile and multi-functional flashlight 10. It should also be appreciated that in the white only version of the light, only the central white LED 32 will be provided and the four peripheral LEDs 38 may or may not be included.

The overall flashlight head assembly 18 can be seen to be received into the first end 16 of the flashlight 10 outer housing 12. The flashlight head assembly 18 is contained within a housing 40 that is also formed to function as a heat sink. The housing 40 may be of any suitable material but is preferably formed from a thermally conductive material and more preferably is formed from a thermally conductive metal material. As can be seen in FIG. 3, the flashlight head 18 housing 40 is positioned such that its outer surface is adjacent the vent openings 24 provided in the flashlight 10 housing 12 thereby allowing dissipation of the heat generated during the operation of the LEDs to the ambient environment. The first LED 32 can be seen positioned on a circuit board 42 that is received into the cavity 44 formed by the flashlight head 18 housing 40 while the peripheral LEDs 38 can be seen to be installed onto a circuit board 46 that is seated at the peripheral edge 36 of the housing 40. In the preferred embodiment, the circuit board 42 onto which the first LED 32 is installed and the circuit board 46 onto which the peripheral LEDs 38 are installed are in thermal communication with the thermally conductive surfaces of the heat sink and more preferably a thermal grease, thermal adhesive or another type of thermally conductive interface is provided therebetween to ensure superior thermal conductivity between these components.

Electrical communication is facilitated between the circuit board 42 onto which the first LED 32 is installed and the circuit board 46 onto which the peripheral LEDs 38 are installed using flexible circuit traces such as wire conductors or more preferably ribbon cable 48. As can be appreciated, while the LEDs can share one common electrical terminal, to facilitate individual control of the first LED 32 and the peripheral LEDs 38, they must each also have an individually addressable or controllable electrical terminal. In this manner, a ribbon conductor 48 having several conductive leads contained therein provides an easy means for providing the necessary electrical connectivity between the two circuit boards 42,46.

Figure 4:
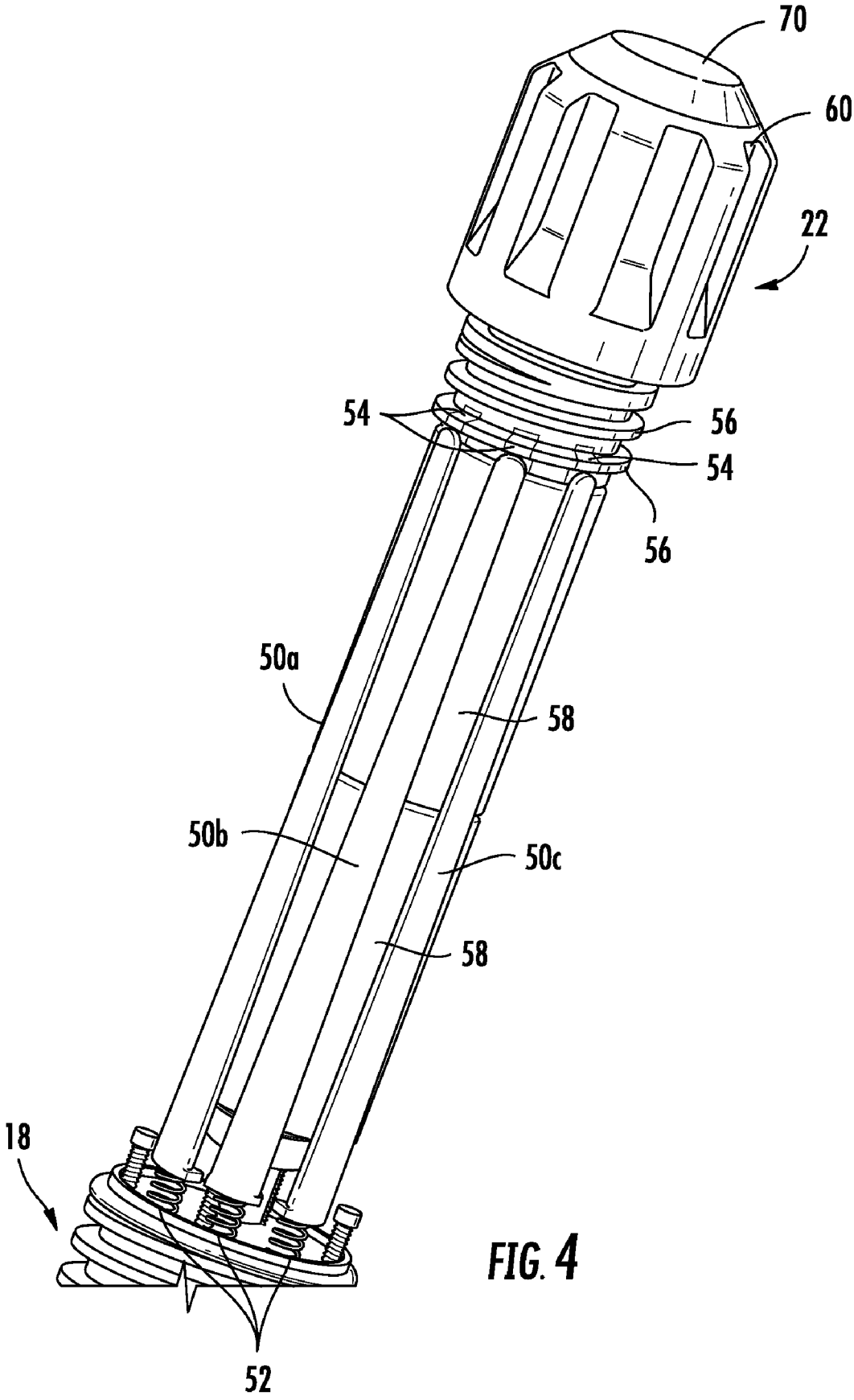
FIG. 4 is a view of the body of the multi-functional flashlight of the present invention with the outer housing removed.

While the operational, light emitting portions of the flashlight 10 are provided in the flashlight head assembly 18, the control for the multi-functionality of the flashlight 10 of the present invention is provided in a novel user interface 22 at the tail cap arrangement of the present invention, wherein as will be discussed in detail below, a combination of a momentary switch and a variable resistance switch are employed to send control signals for the operation of the light itself. To facilitate reliable communication of these signals between the user interface 22 of the tail cap switch and the flashlight head assembly 18 at the front of the flashlight 10, the present invention employs a novel bus system as can best be seen in FIG. 4. In the most general sense, electrical conductors 50*a*, 50*b*, 50*c* must be provided along the interior of the flashlight 10 outer housing 12 to provide electrical connectivity from the first end of the housing 12 to the second end of the housing 12. More preferably, the electrical connectivity between the first end of the housing 12 and the second end of the housing 12 is achieved using electrical conductors 50*a*, 50*b*, 50*c* in the form of bus bars that are slidably installed into channels on the interior sidewall of the flashlight 10 housing 12. The bus bars 50*a*, 50*b*, 50*c* are spring loaded in a manner wherein the springs 52 at the front end of the bus bars 50*a*, 50*b*, 50*c* urge the bus bars 50*a*, 50*b*, 50*c* rearwardly towards the tail cap of the flashlight 10. A power supply 58 in the form of batteries can also be seen to be contained in the flashlight housing 12 adjacent the bus bars 50*a*, 50*b*, 50*c* between the head assembly 18 and the user interface 22. What is notable about this particular arrangement is that the contact pads 54 at the tail cap user interface 22 with which the bus bars 50*a*, 50*b*, 50*c* engage are provided as contact pads that are integrated or formed directly into the threads 56 of the user interface 22 itself. As the user interface 22 is installed, the threads 56 of the user interface 22 depress the bus bars 50*a*, 50*b*, 50*c* urging them downwardly against the spring bias. The user interface 22 is then rotated until it is fully threaded onto the flashlight body and the contact pads 54 in the threads 56 are positioned in contact with their respective bus bars 50*a*, 50*b*, 50*c*. In this arrangement there are three bus bars 50*a*, 50*b*, 50*c*, wherein one bus bar 50*c* one brings power from the rear of the light to the flashlight head assembly 18 at the front of the light and two to bring signals from the momentary switch and the rotary switch respectively within the user interface 22. It is of note that the power contact is the last contact (the one shown at the right side of FIG. 4) to be made as the user interface 22 is installed onto the flashlight 10. This is an important feature because it prevents the power contact from coming into contact with the two other signal contacts in the flashlight, thereby preventing power surges from entering the two signal circuits as the user interface 22 is installed. This arrangement insures positive and reliable contact between the user interface 22 flashlight and the operational head of the flashlight in virtually any condition and under shock loading. It should be further appreciated by one skilled in the relevant art that the user interface could be affixed to the housing in any manner of ways including: threads, cam lock and hinge as well as any other feasible manner.

Figure 5:
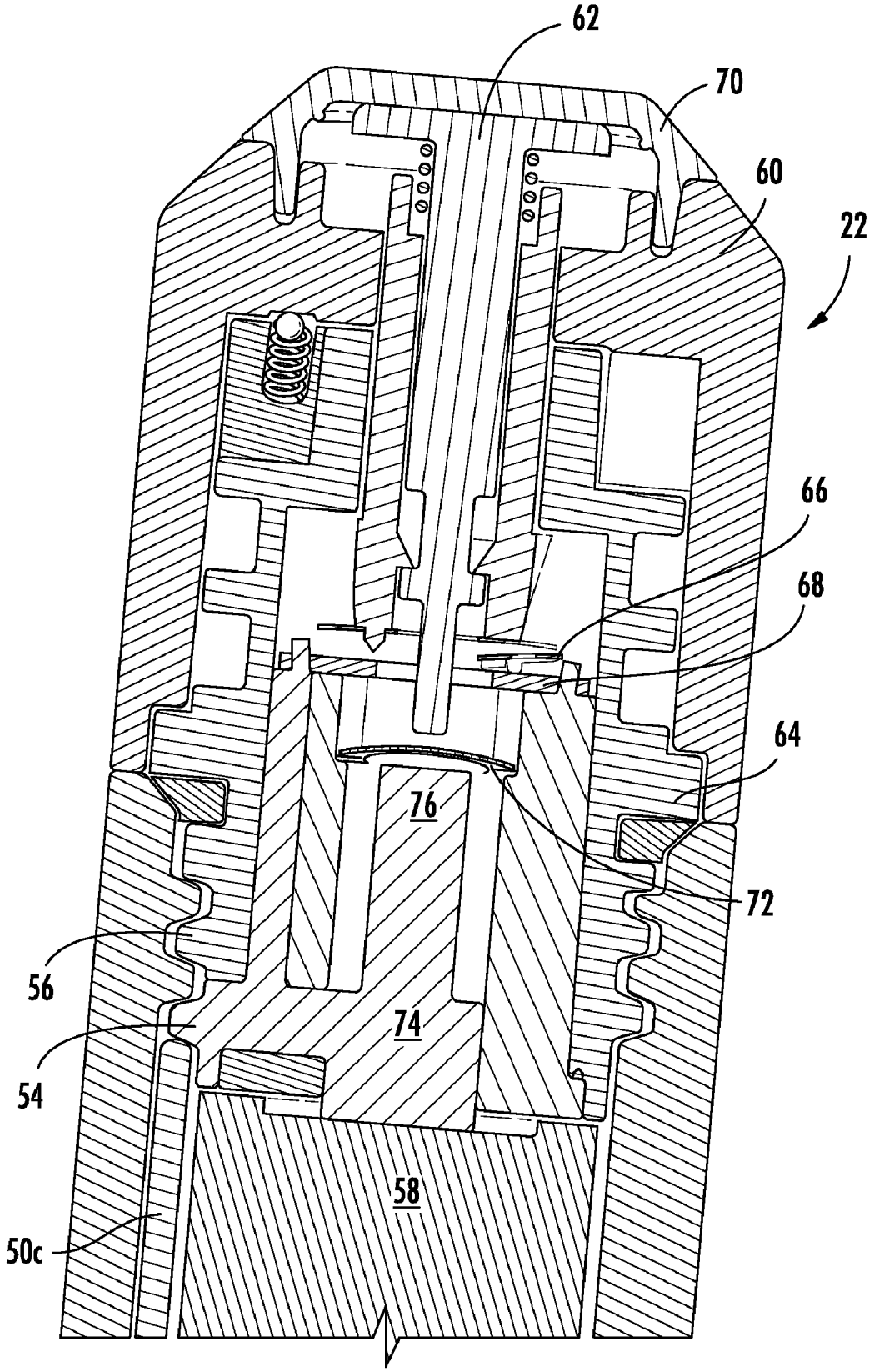
FIG. 5 is a cross-sectional view of the user interface user interface of the multi-functional flashlight of the present invention taken along Line 5-5 of FIG. 1.

Turning to FIG. 5, a cross-section through the user interface 22 of the present invention is generally shown. The user interface 22 includes a rotary actuator 60 and a pushbutton or momentary actuator 62 to facilitate complex multi-functionality in the flashlight 10 of the present invention. The rotary actuator 60 is received about the threaded portion 64 of the user interface 22. The rotary actuator 60 can be rotated to various positions relative to the user interface 22 to allow the user to make flashlight operational mode selections. Preferably the rotary actuator 60 is indexed relative to the threaded portion 64 of the user interface 22 and/or relative to indications contained on the outer housing to allow the user to reliably position the rotary actuator 60 in the various mode selection positions. Rotation of the rotary actuator 60 causes rotation of a wiper 66 assembly affixed thereto relative to a circuit board 68 to generate a first signal as will be described in detail below. Additionally, the momentary actuator 62 can be seen slidably received into the center of the rotary actuator 60 such that the momentary actuator 62 is spring biased rearwardly in the flashlight 10. A cover 70 is received over the momentary actuator 62 to seal the end of the flashlight 10 against the infiltration of water and debris. The momentary actuator 62 when depressed contacts a spring switch 72 such as a dome switch or the like to create a momentary second signal for controlling the flashlight 10. In operation, therefore, power from the power supply 58 is transmitted along one contact 74 within the threaded portion of the user interface 22. The power is transmitted to the front of the flashlight using the bus bar 50*c* and is also transmitted to the circuit board 68 beneath the wiper and the post 76 beneath the momentary contact switch 72. The first signal generated by the rotary actuator 60 is then transmitted down a second of the bus bars 50*a* to the front of the flashlight and the second signal generated by the momentary actuator 72 is transmitted down a third of the bus bars 50*b* to the front of the flashlight.

Figure 6:
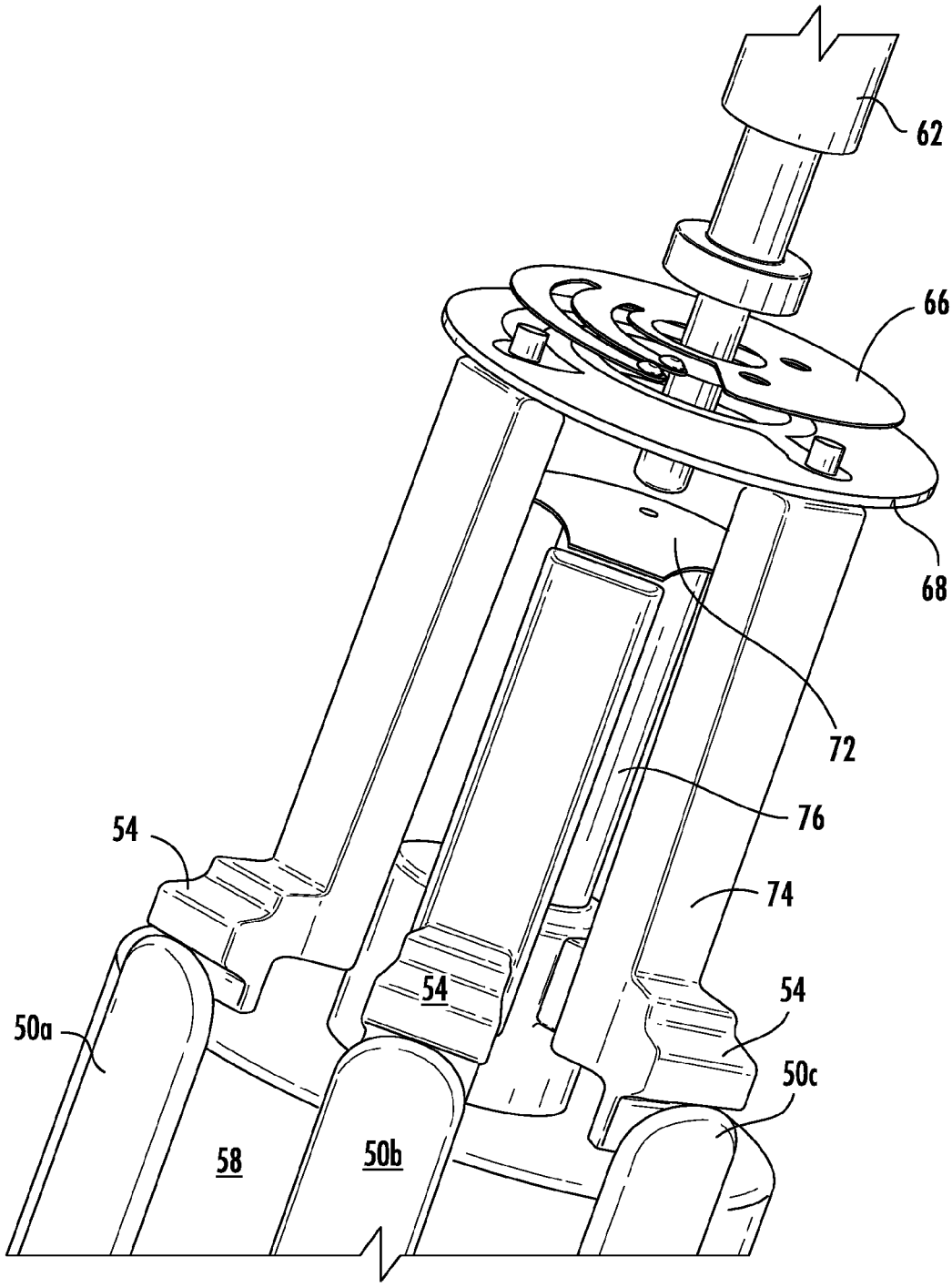
FIG. 6 is a view of the user interface with the outer housing removed to show the functional elements therein.
Figure 7:
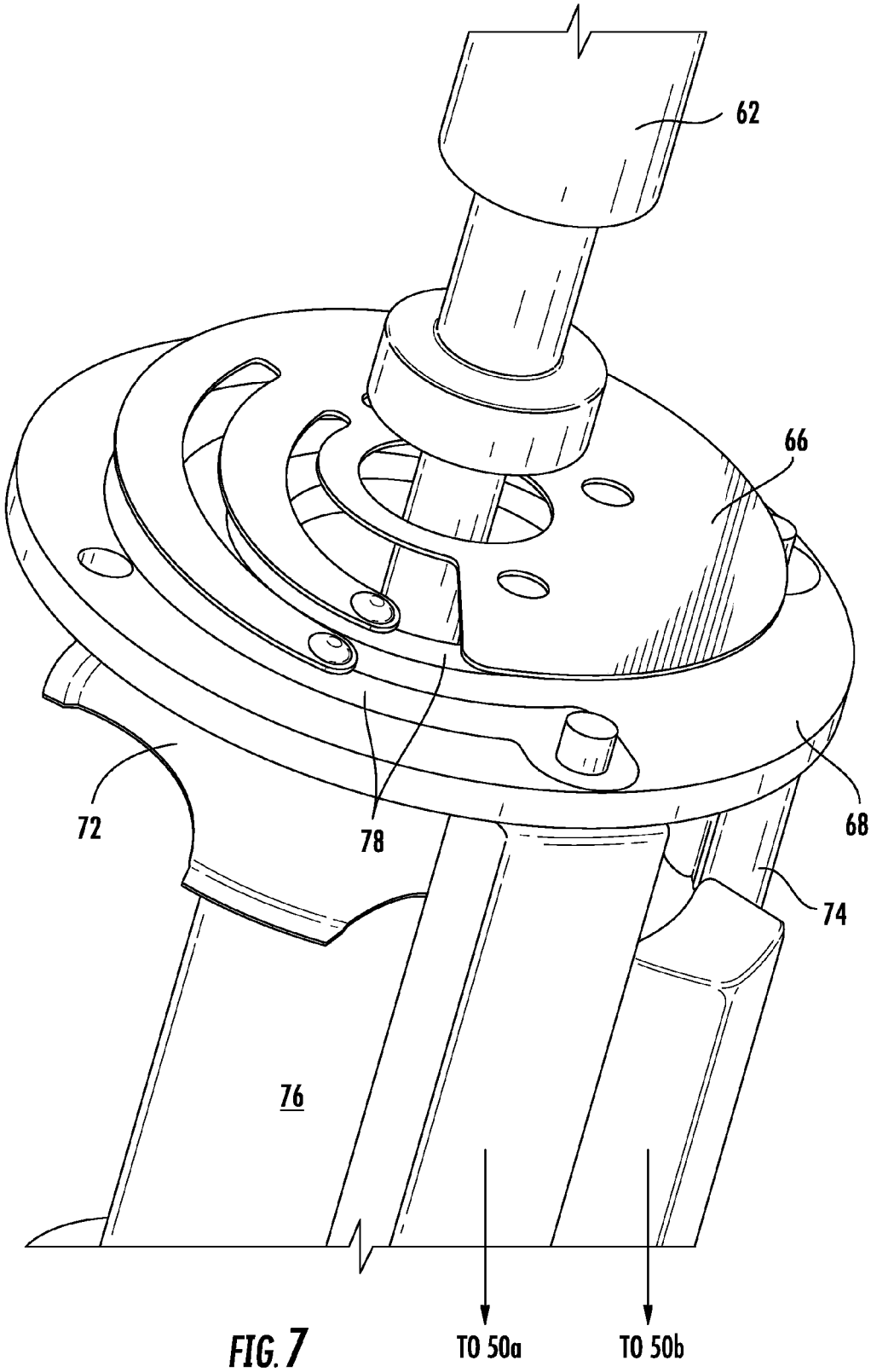
FIG. 7 depicts a first embodiment of the user interface.

Turning now to FIGS. 6 and 7, the details of the construction of a first embodiment user interface 22 for the flashlight 10 are shown. The circuit board 68 includes an adjustable resistance type structure one or both of the continuous strips 78 are resistive strips formed on the surface thereof and the rotary actuator 60 includes a wiper 66 affixed to the end thereof that bridges between the two resistance strips 68. While in the context of the present invention, resistance will be used hereinafter as the signal being generated, the principal of the present invention is directed to using electronic devices having a measurable value wherein a measured value corresponding to the electronic device provides the signal that is read. In this regard, the electronic devices could be any such device having a measurable value such as for example, resistors, capacitors or inductors. Accordingly, while for the remainder of this specification, the signal will be referred to as resistance values and the electronic devices as resistors, any other suitable electronic device having a measurable value could easily be substituted and still fall within the scope of the present invention.

Turning back to FIGS. 6 and 7, it can be seen that rotation of the rotary actuator 60 also serves to rotate the wiper 66 relative to the resistance strips 68 creating a higher resistance value across the wiper contacts 66. In addition, a momentary actuator 62 in the user interface 22 allows the user to press the momentary actuator 62 that in turn contacts a dome switch 72 to generate a momentary contact signal. As was stated above, the power from the rear terminal of the power supply 58 is transmitted up one of the bus bars 50*c*, the resistance signal as read between the resistance strips 78 and the wiper 66 is sent up a second of the bus bars 50*a* and the signal from the momentary actuator 62 is sent along the third bus bar 50*b*. In operation, the flashlight 10 employs a combination of the resistance value detected at the wiper 66 and the momentary signal received from the momentary actuator 62 in order to determine the manner in which the user wants the flashlight 10 to operate. In essence, the momentary actuator 62 toggles the flashlight 10 through various different operational modes such as momentary, full on, strobe, programming mode, etc. While the resistive value is used in order to determine the function or brightness at which the flashlight 10 will operate.

In addition, the programming of the flashlight includes commands whereby if the user engages the said momentary selector for less than a predetermined period of time the flashlight is energized in a first mode while engaging the momentary selector for longer than the predetermined period of time causes the flashlight to be energized in a second mode. In this application such first and second modes may be selected from the group consisting of: programming, momentary, strobe, constant on, high brightness and low brightness. More preferably the first and second modes are selected from the group consisting of: momentary and constant on. Additionally, while the predetermined time threshold may be any duration, in the context of the present invention the predetermined time is of a value that is less than 1 second. More preferably, the predetermined period of time is less than one half second.

Figure 8:
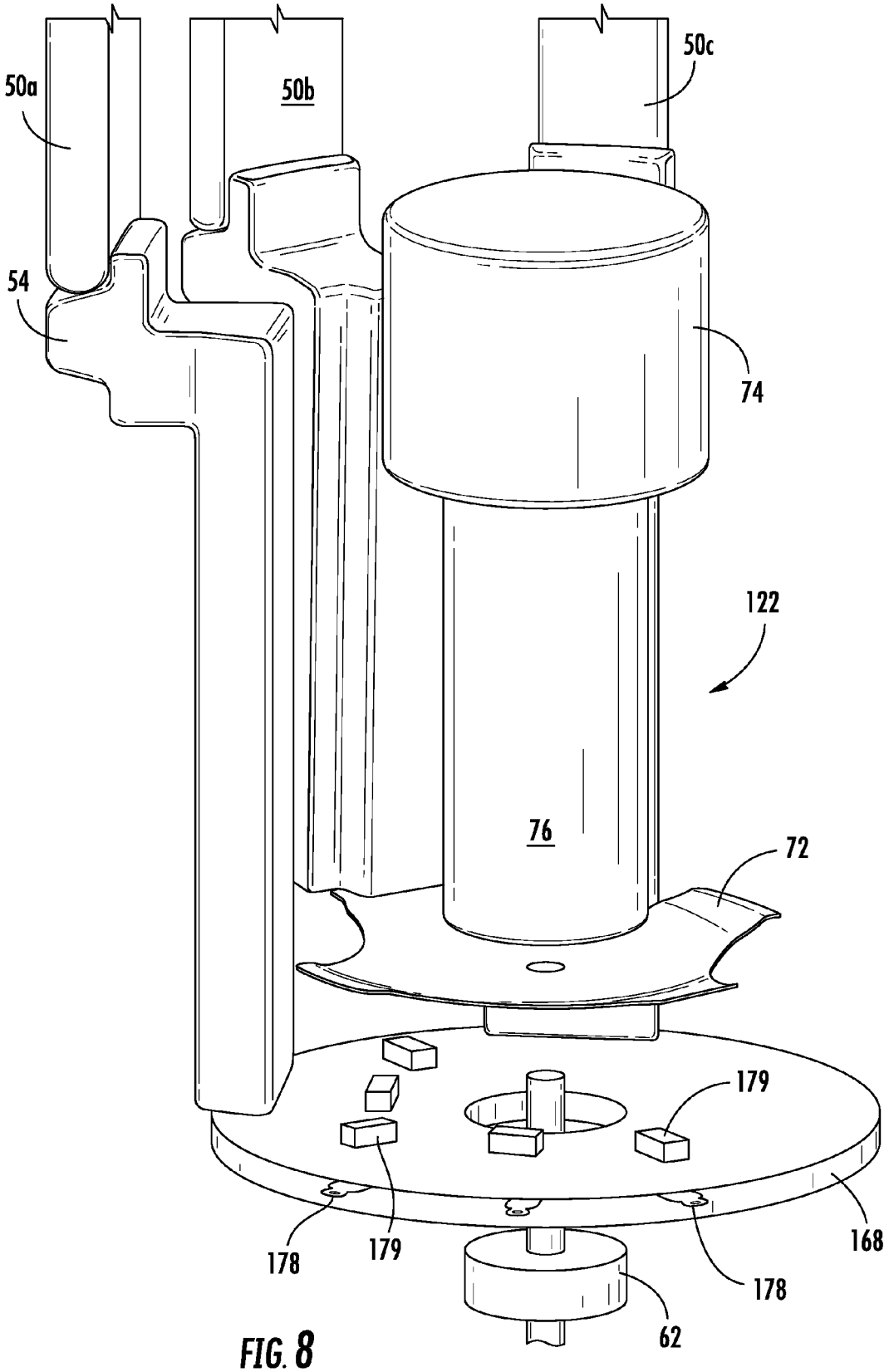
FIG. 8 depicts an inverted view of a second embodiment of the user interface.

Turning now to FIG. 8, the details of a second embodiment user interface 122 for the flashlight 10 are shown. While this embodiment still employs the momentary contact 62, the continuous resistive strips on the circuit board are replaced with a circuit board 168 containing plurality of individual contact pads 178 in indexed positions. A plurality of resistors 179 having different resistive values are arranged such that each of the resistors 179 is positioned in electrical communication with the indexed contact pads 178. When the wiper 66 is rotated into position so that it is in contact with the contact pads 178, a signal is provided that corresponds to a fixed and known resistive value corresponding to the resistor 179 in that position. In this regard, each rotation of the user interface 122 to an indexed location moves the wiper 66 into a fixed resistance position that is read by the operational circuit of the flashlight and is used to execute a predetermined operational command. In this mode, one of the positions corresponds to a program mode where when positioned here, depressions of the pushbutton switch then cycles the light through its various color options, red, green, blue, ultraviolet, infrared and white, for example. Once the color operation is selected, then rotation to the other positions correspond to other functions such as high and low power, momentary operation, etc. Once the mode is set, depression of the momentary contact then launches that operation.

Figure 9:
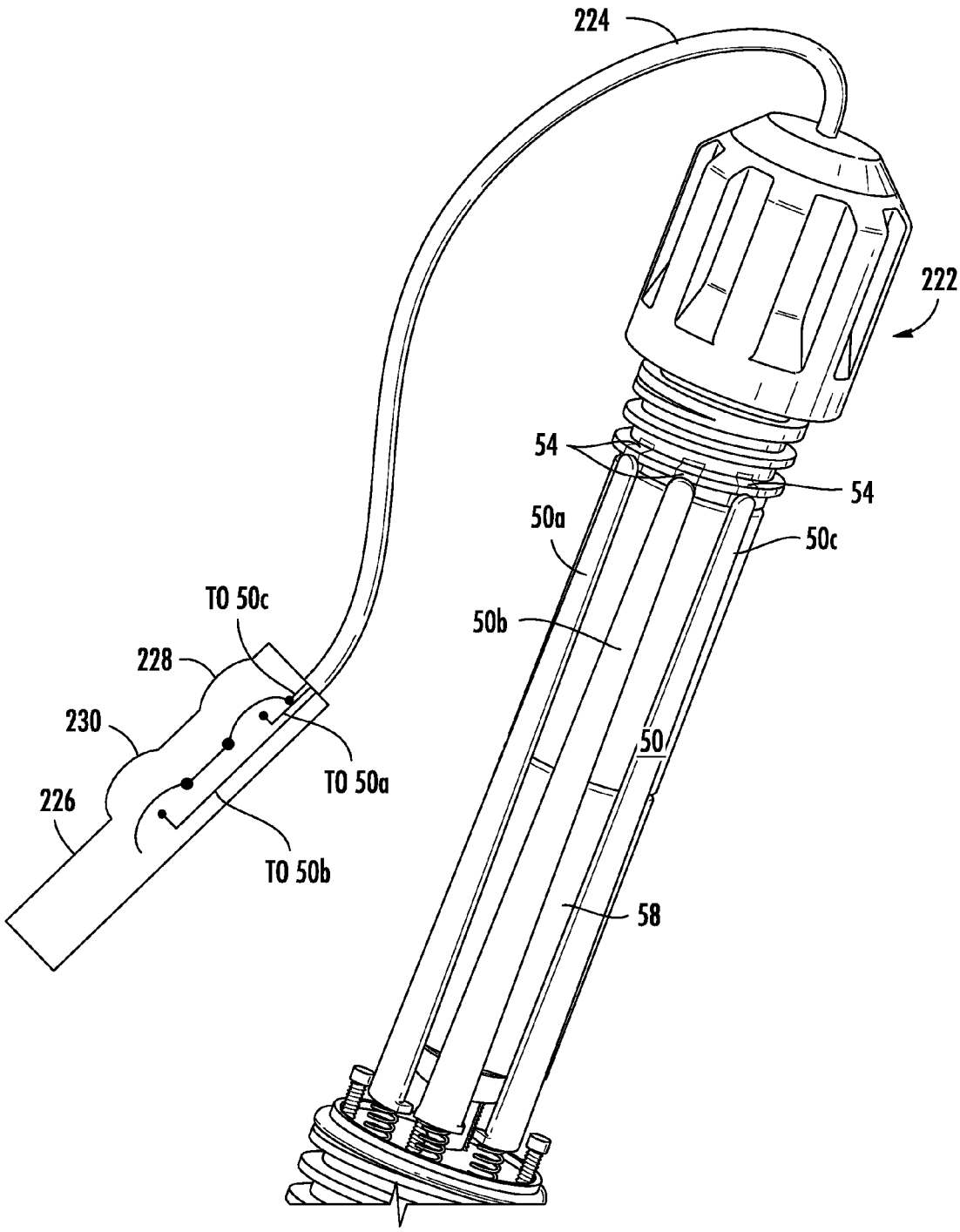
FIG. 9 depicts a third embodiment of the user interface.

Turning now to FIG. 9, the details of a third embodiment user interface 222 for the flashlight are shown. In this embodiment, the rotary selector and the momentary contact are removed and a wire 224 is extended out from the user interface 222 to a tape switch 226 arrangement. The tape switch 226 includes two push buttons 228, 230. The flashlight technology of the present invention allows the flashlight to be adaptive to the particular user interface that is installed thereon thereby allowing the flashlight itself to sense whether the interface is actually a rotary interface or a tape switch interface. The two buttons 228, 230 on the tape switch 226 are in electrical communication with the bus bars 50*a*, 50*b* and 50*c* and serve to send a signal to the flashlight along the bus bars in the same fashion as does the rotary actuator. This interface 222 is constructed to be modular so that it can be interchanged with the user interface 22 and 122 embodiments described above. In operation, the push buttons 228, 230 both generate signals that have a resistance value that is nearly zero as compared to the various contact positions in the rotary actuator. When such a signal having nearly zero resistance is received at the controls in the flashlight, the flashlight knows that a tape switch 226 instead of a rotary actuator is controlling it.

Figure 10:
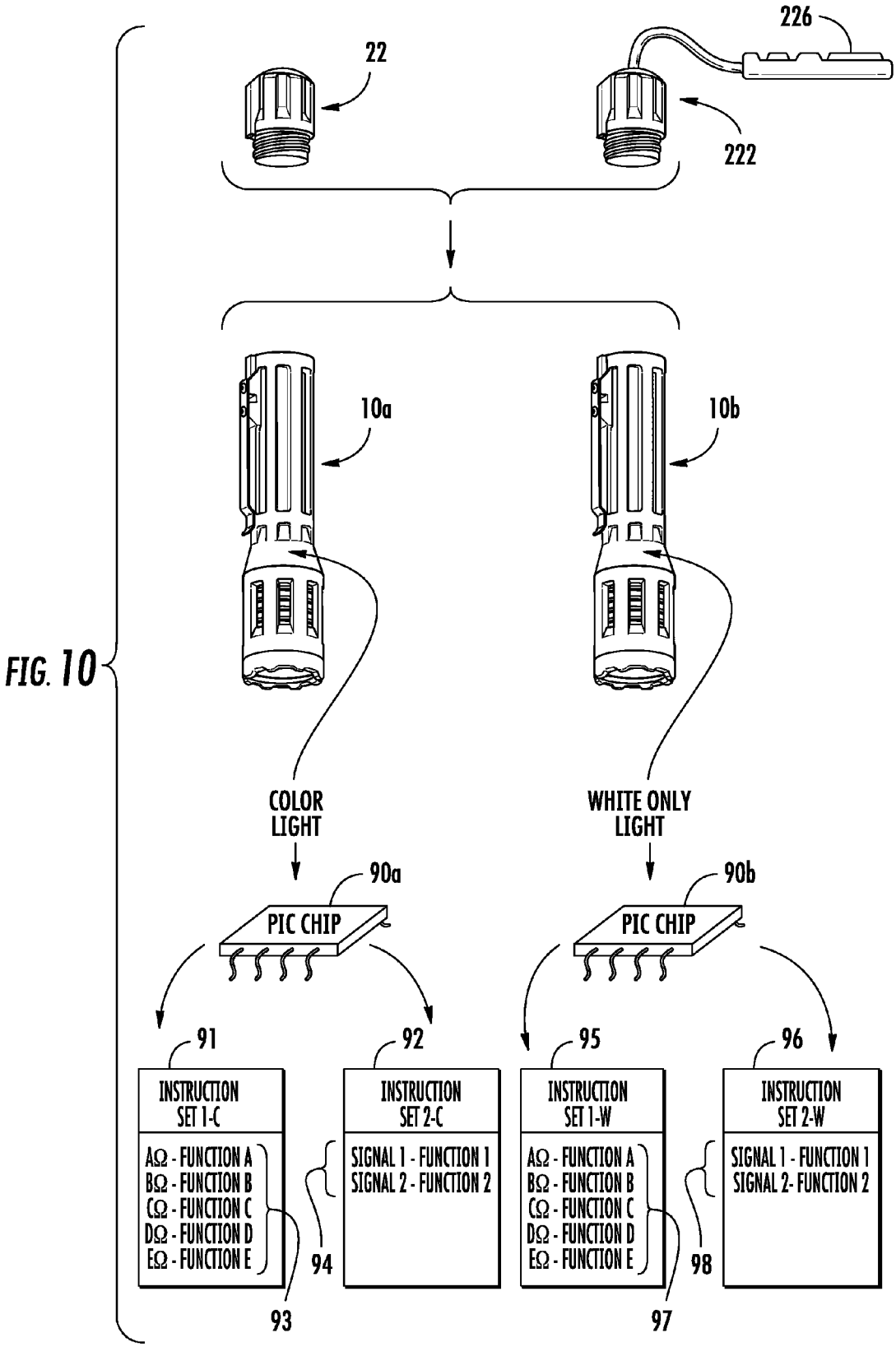
FIG. 10 provides a schematic illustration of the adaptive operation of the flashlights of the present invention.

Turning now to FIG. 10 a schematic diagram is shown depicting the interrelationship between the flashlight in either a color version 10*a* shown at the left and an all white version 10*b* shown at the right, the user interfaces 22 and 222 and the control system within the flashlights 10*a*, 10*b*. Within each of the flashlights 10*a*, 10*b* memory chip 90*a*, 90*b* is provided wherein the memory chip 90*a*, 90*b* has instructions for controlling the functionality of the flashlight. In a color version of the flashlight 10*a*, the memory chip 90*a* includes a plurality of instruction sets 91, 92 that provide unique operating instructions 93, 94 depending on the interface 22, 222 that is installed and the manner in which the interface 22, 222 is operated. Similarly, in an all white version of the flashlight 10*b*, the memory chip 90*b* includes a plurality of instruction sets 95, 96 that provide unique operating instructions 97, 98 depending on the interface 22, 222 that is installed and the manner in which the interface 22, 222 is operated. When for example a rotary interface 22 is installed onto either of the flashlights, the flashlight identifies the interface as being a rotary interface 22 based on the existence of resistive signals therein and accordingly selects instruction set 1-C 91 in a color flashlight 10*a* or 1-W 95 in a white flashlight 10*b*. Then as the rotary interface 22 is operated as described above distinct resistive signals are sent to the controller and the function 93 corresponding to that resistive signal is selected from the memory chip 90*a* and is employed to energize the flashlight 10*a*. For example, if the resistive value is A-Ohms, then the function 93 selected is the function corresponding to A-Ohms and so on.

Should a tape switch interface 222 be installed onto either of the flashlights 10*a*, 10*b*, the flashlight identifies the interface based on the lack of resistive signals therein and accordingly selects instruction set 2-C 92 in a color flashlight 10*a* or 2-W 96 in an all white flashlight 10*b*. Then as the interface 222 is operated as described above distinct signals are sent from the discrete pushbuttons 228, 230 to the controller and the function 94, 98 corresponding to that signal is selected from the memory chip 90*a*, 90*b* and is employed to energize the flashlight 10*a*, 10*b*. For example, if Signal 1 is received, then the function 994, 98 selected is the function corresponding to Signal 1 and so on.

In terms of a method of operating a flashlight, a flashlight including a plurality of memory registers therein is provided. In addition at least two user interfaces for controlling the flashlight are provide. The user selects and installs one of the at least two user interfaces onto the flashlight to operate the flashlight. When operated the user interface generates a signal that is received by a controller within the flashlight. Based on the signal received, the controller selects a set of operational instructions from a corresponding memory register on a memory storage chip within the flashlight and energizes the flashlight based on the operation of the user interface and in accordance with the selected set of operational instructions. Further, it can be appreciated that the method anticipates the use of a user interface such as those already described in detail herein and therefore such user interfaces operate as described in detail above. In addition, such a method provides for those operational modes as were described above It can be appreciated that all of the components of the flashlight may be milled or cast from metallic materials. Similarly, the materials may be molded from high strength polymer materials. Finally, the materials may be insert molded using a combination of metallic and polymer components as may be necessary to create the durability and strength demanded by the application.

It can therefore be seen that the present invention provides an improved flashlight construction that includes multi-functionality in an interface that is easier to operate and exhibits a high degree of reliability even in the most rugged environment. Further, the present invention provides a multi-function flashlight that is modular in construction to thereby allow the interchangeability of parts thereon so that the flashlight can easily be maintained in operable condition. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A flashlight comprising:

a housing having a first end with a peripheral edge;

a reflector received within said first end and bounded by said peripheral edge;

a light emitting diode received within the reflector;

at least one light emitting diode positioned outside said reflector proximate to the peripheral edge of the housing;

a power supply disposed within said housing; and a user interface affixed to said housing to allow a user to selectively energize and control a mode of operation of the light emitting diode within the reflector and the at least one light emitting diode at the peripheral edge of the housing.

2. The flashlight of claim 1, wherein said at least one light emitting diode is a plurality of light emitting diodes positioned at the peripheral edge of the housing.

3. The flashlight of claim 2, wherein said plurality of light emitting diodes are spaced apart around the peripheral edge of the housing.

4. The flashlight of claim 2, wherein the light emitting diode within the reflector and the plurality of light emitting diodes at the peripheral edge of the housing are the same color.

5. The flashlight of claim 2, wherein the light emitting diode within the reflector is a first color and the plurality of light emitting diodes at the peripheral edge of the housing are a second color.

6. The flashlight of claim 2, wherein the light emitting diode within the reflector is a first color and the plurality of light emitting diodes at the peripheral edge of the housing are each a different color from the first color and one another.

7. The flashlight of claim 1, wherein the light emitting diode within the reflector and the at least one light emitting diode at the peripheral edge of the housing are the same color.

8. The flashlight of claim 1, wherein the light emitting diode within the reflector is a first color and the at least one light emitting diode at the peripheral edge of the housing is at least one other color.

9. The flashlight of claim 1, the user interface comprising:

a rotary selector; and a momentary selector, wherein the rotary selector, in a first position allows the user depress the momentary selector to select which of the light emitting diode within the reflector and the at least one light emitting diode to energize, the rotary selector in at least a second position allows the user to depress the momentary selector to energize the selected light emitting diode in a desired operational mode.

10. The flashlight of claim 9, wherein the rotary selector can be moved to a plurality of positions to allow the user to select a mode from the group consisting of: programming, momentary, strobe, constant on, high brightness and low brightness.

11. The flashlight of claim 1, the user interface comprising:

a tape switch having a first button and a second button thereon, wherein the first button provides a first signal to execute a first manner of operation and the second button provides a second signal to execute a second manner of operation.

12. The flashlight of claim 11, wherein the tape switch can toggle the operation of the flashlight to allow the user to select a mode from the group consisting of: programming, momentary, strobe, constant on, high brightness and low brightness.

13. The flashlight of claim 1, the housing further comprising:

a mounting platform on an outer surface thereof consisting of two spaced apart raised structures defining a space therebetween; and a belt clip affixed to the mounting platform, wherein the raised structures of the mounting platform and belt clip cooperate to enclose a hole therethrough for attachment of an accessory device.

14. A flashlight comprising:

a housing having a first end with a peripheral edge;

a reflector received within said first end and bounded by said peripheral edge;

light emitting diode having a first color received within the reflector;

a plurality of light emitting diodes positioned outside said reflector at the peripheral edge of the housing each having a different color from the first color and from one another;

a power supply disposed within said housing; and a user interface affixed to said housing to allow a user to selectively energize and control a mode of operation of the light emitting diode within the reflector and the at least one light emitting diode at the peripheral edge of the housing.

15. The flashlight of claim 14, wherein the colors of the light emitting diode within the first end of the housing and the plurality of light emitting diodes at the peripheral edge of the housing are selected from the group consisting of: white, red, blue, green, ultraviolet and infrared.

16. The flashlight of claim 14, the user interface comprising:

a rotary selector; and a momentary selector, wherein the rotary selector, in a first position allows the user depress the momentary selector to select which of the light emitting diode within the first end of the housing and the plurality of light emitting diodes to energize, the rotary selector in at least a second position allows the user to depress the momentary selector to energize the selected light emitting diode in a desired operational mode corresponding to the at least a second position.

17. The flashlight of claim 16, wherein the rotary selector can be moved to a plurality of positions to allow the user to select a mode from the group consisting of: programming, momentary, strobe, constant on, high brightness and low brightness.

18. The flashlight of claim 14, the housing further comprising:

a mounting platform on an outer surface thereof consisting of two spaced apart raised structures defining a space therebetween; and a belt clip affixed to the mounting platform, wherein the raised structures of the mounting platform and belt clip cooperate to enclose a hole therethrough for attachment of an accessory device.

* * * * *